United States Patent [19]

Fife

[11] 4,206,753

[45] Jun. 10, 1980

[54] METHOD AND APPARATUS FOR MIXING GASES

[76] Inventor: William P. Fife, 3616 Sunnybrook La., Bryan, Tex. 77801

[21] Appl. No.: 852,056

[22] Filed: Nov. 16, 1977

[51] Int. Cl.[2] ..... A62B 7/00

[52] U.S. Cl. ..... 128/201.21; 128/203.29; 128/205.25; 252/372; 137/93; 137/7; 137/88; 137/604; 48/180 C; 366/107; 23/230 A; 424/366

[58] Field of Search ..... 128/142 R, 142 G, 142.2, 128/142.3, 142.5, 142.7, 147, 188, 203, 204, 209, 210; 137/93, 7, 88, 604; 252/372; 48/180 C, 117; 366/101, 107; 23/230 A, 108; 424/366

[56] References Cited

U.S. PATENT DOCUMENTS

| | | | |
|---|---|---|---|
| 2,830,583 | 4/1958 | Finney, Jr. | 128/142 R |
| 3,101,902 | 8/1963 | Chamberlain et al. | 137/604 |
| 3,418,176 | 12/1968 | Anthes | 252/372 X |
| 3,957,043 | 5/1976 | Shelby | 128/142 G |
| 4,026,283 | 5/1977 | Banjavich et al. | 128/142.3 |

*Primary Examiner*—Henry J. Recla

*Attorney, Agent, or Firm*—Pravel, Gambrell, Hewitt, Kirk, Kimball & Dodge

[57] ABSTRACT

Oxygen is mixed into hydrogen for use as breathing gas for divers, pressure chambers and the like in precise and regulated amounts. Provision is also made to prevent explosion of these mutually reactive gases during mixing.

10 Claims, 1 Drawing Figure

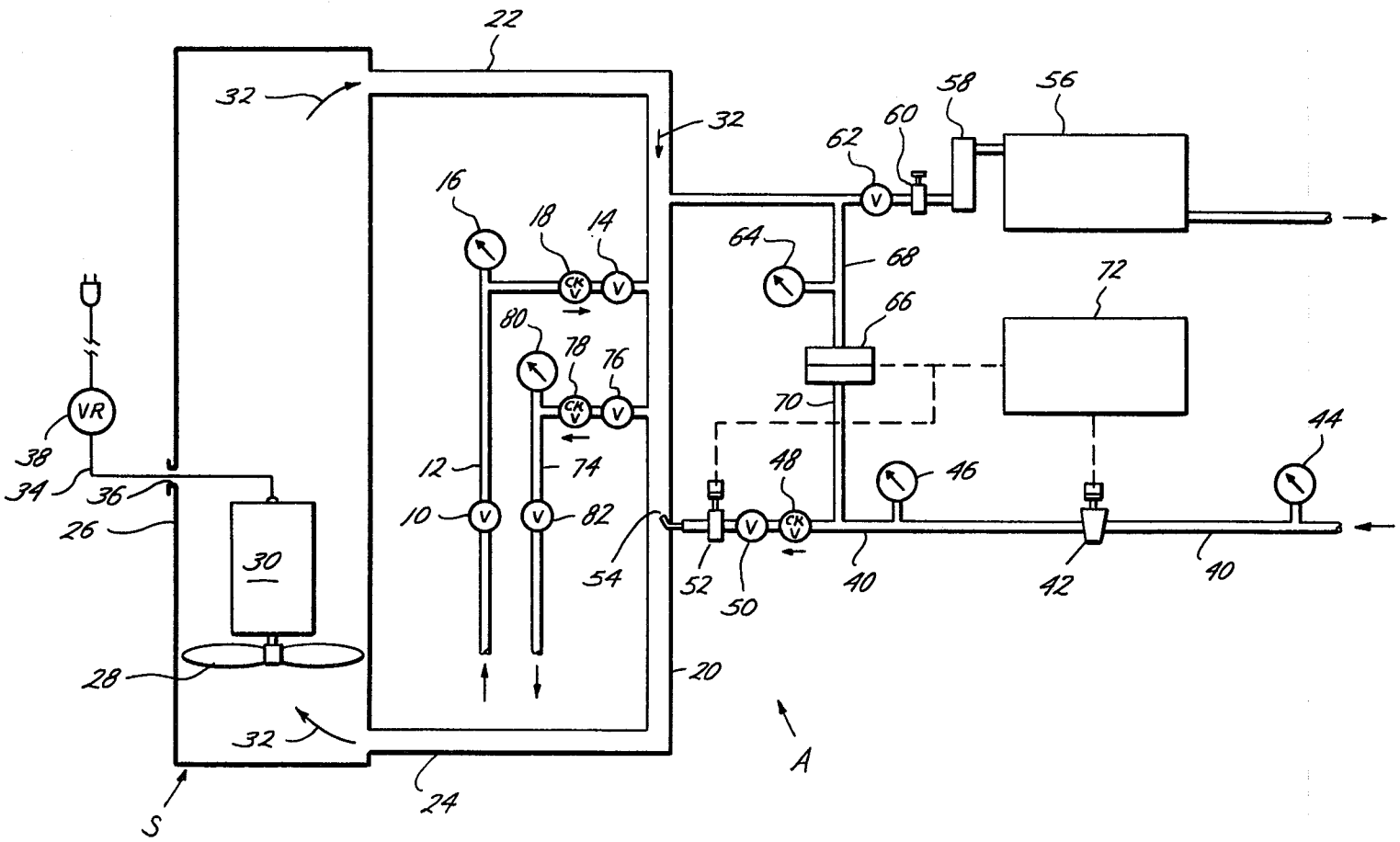
10
12
14
16
18
20
22
24
26
28
30
32
34
36
38
40
42
44
46
48
50
52
54
56
58
60
62
64
66
68
70
72
74
76
78
80
82
A
S
VR
CK V

METHOD AND APPARATUS FOR MIXING GASES

The invention herein described was made in the course of or under a contract or subcontract thereunder with the Office of Naval Research.

BACKGROUND OF THE INVENTION

1. Field of Invention

The present invention relates to mixing gases for use as breathing gas.

2. Description of Prior Art

There have been apparatus or systems in the prior art for mixing oxygen with one or more gases for breathing purposes. Examples are U.S. Pat. Nos. 3,534,753; 2,818,860; 3,727,627; 3,669,134; 3,598,134; 3,762,427; and 3,762,428. For the most part, these systems were intermittent or "demand" systems—the gases were mixed together in proportions in response to use of the end product mixed gas. Thus, the gases were mixed in their final proportions as a single event each time there was use of the end product. Since the gases being mixed in these systems were not reactive with each other, an attempt to use them with reactive gases could result in a sustained fire which was continuously fed by incoming reactive gases or an explosion. Further, if flow rates became low, back diffusion of one reactive gas into the other caused a hazardous situation.

It has been proposed to use hydrogen as the mixing gas for oxygen for supply to divers and pressure chambers, particularly to hyperbaric pressures or for use at great depths. However, these two gases are so mutually reactive, unless their relative mixture was precisely and constantly controlled that mere turning on or off of the system could cause explosion.

SUMMARY OF INVENTION

Briefly, the present invention provides a new and improved method and apparatus for mixing precise and regulated amounts of oxygen into a carrier gas, usually hydrogen, to form a breathing gas for use by divers or in hyperbaric chambers. The oxygen is injected into the carrier gas from an injection jet. The carrier gas is circulated in repeated passes past the oxygen injection jet in a conduit system. The rate of flow of the hydrogen past the oxygen jet is far greater than that represented by its final percentage of the breathing mixture, so that virtually instantaneous mixing and dilution of the oxygen occur. In this manner, the mutually reactive hydrogen and oxygen can be safely mixed to precise and regulated mixture percentages. The mixture percentages can be varied, if desired.

BRIEF DESCRIPTION OF THE DRAWINGS

The single FIGURE in the drawings is a schematic diagram of an apparatus of the present invention.

DESCRIPTION OF THE PREFERRED EMBODIMENT

In the drawings, the letter A designates generally an apparatus according to the present invention for mixing precise and regulated amounts of oxygen into a carrier gas which is reactive with the oxygen, such as hydrogen. The mixed gas is then available for a breathing gas for use in hyperbaric chambers or in diving masks. For high pressure or increased depth usages, the percentage of oxygen in the breathing gas must be reduced from that normally present at pressures of one atmosphere, since it has been found that oxygen has toxic effect on users if normal oxygen percentages are present in breathing gases at such depths. Accordingly, with the present invention, it is important to precisely and accurately control the amount of oxygen in the breathing gas. For example, at depths of about 2,000 feet of sea water, the normal oxygen level required in the breathing mixture is on the order of 0.3 percent.

In the apparatus A, the hydrogen carrier gas is received at an input valve 10 and passes through a conduit 12 to a supply valve 14, which when open permits the hydrogen to enter the apparatus A and have mixed therein the oxygen, in a manner to be set forth. A pressure gauge 16 is provided to indicate the pressure of hydrogen gas in the conduit 12, while a one-way or non-return valve 18 is provided to prevent reverse or backflush flow of oxygen containing gas into the stream of hydrogen in the conduit 12.

The hydrogen enters a mixing manifold 20 of a circulating conduit system S, which includes connecting conduits 24 and a mixing tower or column 26. A fan 28 driven by an electrical motor 30 is mounted in the mixing tower 26 to continuously mix and recirculate gases within the conduit system S at a high rate of flow, for reasons to be set forth, in a direction indicated by arrows 32. The motor 30 driving the fan 28 receives operating electrical power through conductors 34 passing through suitable sealed inlets formed in the mixing conduit 26. The amount of electrical power flowing through the conductors 34 to the motor 30 is controlled by a voltage regulator 38 which receives operating electrical power from a suitable electrical power source.

The oxygen gas to be mixed with hydrogen in the apparatus A is provided through a conduit 40 to a pressure regulator 42 which regulates the input pressure of the oxygen to be mixed with the hydrogen in the mixing manifold 20. The pressure of the oxygen in the conduit 40 exceeds that of the carrier gas within the mixing manifold 20 to prevent entry of hydrogen into the conduit 40. An input oxygen pressure gauge 44 senses the input pressure of the oxygen, while a pressure gauge 46 senses the output pressure of the oxygen from the pressure regulator 42 so that it can be ascertained that the pressure of oxygen from the pressure regulator 42 exceed the pressure of the carrier gas within the mixing manifold 20. The oxygen from the pressure regulator 42 flows through the conduit 40 through a non-return valve 48 which is a further safety mechanism to prevent hydrogen flow into conduit 40, an on-off supply valve 50 and a variable input control valve 52 to an injector jet 54. The injector jet 54 directs oxygen, the amount of which has been established by the setting of the input valve 52, countercurrently against the gas circulating in the loop S, as moved by the fan 28. By directing the oxygen countercurrently against the gases circulating in the conduit system S virtually instantaneous dilution of the oxygen by the carrier gas is accomplished.

In order to precisely measure the amount of oxygen injected by the jet 54 into the stream of carrier gas and the mixing manifold 20, an oxygen analyzer 56 is connected through a flow meter 58 and a needle valve 60 by a shut-off valve 62 to the mixing manifold 20. The valve 62 is open during mixing operations so that gases in mixing manifold 20 may be analyzed in the analyzer 56. The oxygen analyzer 56 thus obtains a measure of the percentage of oxygen flowing in the mixing manifold 20 so that a determination can be made as to whether the proper percentage of oxygen is present in the gas mixture being formed by the apparatus A.

A pressure gauge 64 is also in fluid communication with the mixing manifold 20 in order that the pressure of gas within the conduit system S may be monitored. A differential pressure transducer 66 is connected by a conduit 68 to the mixing manifold 20 and by a conduit 70 to the conduit 40. The transducer 66 forms an electrical signal indicating the differential in pressure between the mixing manifold 20 and the oxygen inlet conduit 40 which is provided (as indicated by the arrow) to a pressure gauge 72.

Readings on the differential pressure gauge 72 and oxygen analyzer 56 provide an operator with an indication of the necessary adjustments to be made in the output pressure of the oxygen from the pressure regulator 42 and the amount of oxygen permitted to enter the jet 54 through the variable inlet valve 52 so that adjustments may be made to control and regulate the amount of oxygen being injected into the carrier gas in the mixing manifold 20. If desired, suitable servomechanisms (indicated by dashed lines) may be utilized operating in response to output signals from the oxygen analyzer 56 to automate the adjustment of the pressure regulator 42 and inlet valve 52.

An output conduit 74 is connected through a supply valve 76 and a non-return valve 78 to the mixing manifold 20. A pressure gauge 80 indicates the pressure of the product gas mixture formed in the apparatus A present in the outlet conduit 72. An outlet valve 82 permits connection through suitable conduits to a hyperbaric chamber, a conduit to a diver's mask or to a storage cylinder.

In the operation of the present invention, the motor 30 of the fan 28 is initially activated. A suitable purging gas, such as nitrogen, is introduced through the hydrogen input line 12 and the apparatus A pressurized to a suitable pressure. All conduits in the apparatus A are then flushed with nitrogen. This procedure is repeated a suitable number of times.

The oxygen input conduit 40 is then flushed with oxygen and the valve 54 closed. At this time, the oxygen line 40 is pressurized to a suitable pressure, such as 100 psi. To purge the nitrogen from the remaining structure of the apparatus A, such structure other than the inlet conduit 40 is then pressurized with hydrogen to a suitable pressure. The outlet conduit 74 is opened and the structure thus purged with hydrogen a suitable number of times.

After the apparatus A has been purged in the foregoing manner, it is pressurized with hydrogen to a suitable pressure, such as 1500 psi. Simultaneously, the oxygen line of pressure is increased by the pressure regulator 42 so that there is no more than a 100 psi differential across the pressure transducer 66 in order to prevent damage thereto.

The pressure of the oxygen at the output of the pressure regulator 42 is then adjusted to 20 psi over the manifold pressure in the mixing manifold 20 and valves 60 and 62 are opened to permit flow of gas from the mixing manifold 20 to the oxygen analyzer 56.

Valve 52 is now opened and oxygen is allowed to flow into the mixing manifold 20 through the injector jet 54. The hydrogen carrier gas, with increasing levels of oxygen being injected thereto, is thus becoming the breathing gas and is continuously and repeatedly circulated through the conduit system S in multiple passes past the jet 54 insuring virtually instantaneous and thorough mixing of the two mutually reactive gases, thereby preventing explosion. It is important to note that the volume rate of flow of hydrogen past the jet 54 far exceeds the inflow rate of oxygen so that no explosive mixture of oxygen in the breathing gas mix is formed. In this manner, trace levels of oxygen may be safely introduced directly and safely into the rapidly flowing hydrogen until the desired concentration level is obtained.

The oxygen analyzer 56 monitors the oxygen level as the level of oxygen in the gas within the mixing manifold 20 gradually increases by means of injection from the jet 54. Upon reaching the desired oxygen level, such as three percent, the valve 52 is closed to stop further oxygen input. The mixture of hydrogen and oxygen within the conduit system S is continuously recirculated under the influence of the fan 28 with the valve closed so that thorough mixing of the hydrogen and the oxygen takes place. At this time, the valve 76 may be opened to transfer the output hydrox gas mixture through conduit 74 to storage cylinders or for use.

It is important to note that with the present invention, the percentage of oxygen in the hydrogen carrier gas should be kept to five percent or less of oxygen. Unless this precaution is taken, the risk of explosion or fire in the event of mere opening of a valve exists.

The foregoing disclosure of the present invention is illustrative and explanatory thereof, and various changes in the size, shape and materials as well as in the details of the preferred embodiment may be made without departing from the spirit of the invention.

I claim:

1. A method of forming precise and regulated mixture percentages of oxygen in a breathing gas, comprising the steps of:

(a) injecting the oxygen into a stream of hydrogen carrier gas from an injection jet at a flow rate substantially lower than the flow rate of the stream of carrier gas, and with the percentage of oxygen in the hydrogen carrier gas being five percent or less; and (b) circulating the hydrogen carrier gas past the oxygen injection jet during said step of injecting to form the breathing gas.

2. The method of claim 1, wherein said step of circulating comprises the step of:

repeatedly circulating the stream of hydrogen carrier gas in multiple passes past the oxygen injection jet.

3. The method of claim 1, further including the step of:

transferring the breathing gas into a hyperbaric chamber.

4. The method of claim 1, further including the step of:

transferring the breathing gas into a diver's mask.

5. The method of claim 1, further including the step of:

measuring the percentage of the oxygen in the breathing gas.

6. The method of claim 1, further including the step of:

maintaining the percentage of the oxygen in the breathing gas substantially constant.

7. The method of claim 1, further including the step of:

comparing the input pressure of the oxygen with the pressure of the circulating mixed gases.

8. The method of claim 1, wherein the stream hydrogen carrier gas is circulated in a conduit system prior to said step of injecting the oxygen.

9. An apparatus for forming precise and regulated mixture percentages of oxygen in a breathing gas, comprising:

(a) means for supplying a stream of hydrogen carrier gas;

(b) means for injecting the oxygen into the hydrogen carrier gas at a flow rate substantially lower than the flow rate of the stream of carrier gas to form the breathing gas, and with the percentage of oxygen in the hydrogen carrier gas being five percent or less;

(c) conduit means for circulating the stream of hydrogen carrier gas and injected oxygen as they are mixed; and (d) means in said conduit means for continuously circulating the mixed gases passed through said conduit means to thoroughly mix same thereby forming the breathing gas.

10. The apparatus of claim 9, wherein said means for injecting comprises:

means for injecting the oxygen non-explosively into the stream hydrogen carrier gas.

* * * * *